US007714827B2

(12) United States Patent
Kubota et al.

(10) Patent No.: US 7,714,827 B2
(45) Date of Patent: May 11, 2010

(54) INTEGRATED CIRCUIT FOR SCAN DRIVING

(75) Inventors: Yasushi Kubota, Ibaraki (JP); Seiji Murakami, Hayami-gun (JP)

(73) Assignee: Texas Instruments Incorporated, Dallas, TX (US)

( * ) Notice: Subject to any disclaimer, the term of this patent is extended or adjusted under 35 U.S.C. 154(b) by 1536 days.

(21) Appl. No.: 10/717,235

(22) Filed: Nov. 18, 2003

(65) Prior Publication Data

US 2004/0160432 A1 Aug. 19, 2004

(30) Foreign Application Priority Data

Nov. 29, 2002 (JP) ..... 2002-348991

(51) Int. Cl.
*G09G 3/36* (2006.01)

(52) U.S. Cl. ..... 345/100; 345/204

(58) Field of Classification Search ..... 345/76, 345/80, 87, 98–100, 204, 690
See application file for complete search history.

(56) References Cited

U.S. PATENT DOCUMENTS 4,908,710 A * 3/1990 Wakai et al. ..... 348/793
5,598,180 A * 1/1997 Suzuki et al. ..... 345/100
5,774,099 A * 6/1998 Iwasaki et al. ..... 345/87
5,907,314 A * 5/1999 Negishi et al. ..... 345/103
6,124,852 A * 9/2000 Yamagishi et al. ..... 345/209
6,501,456 B1 * 12/2002 Saito et al. ..... 345/98
6,545,655 B1 * 4/2003 Fujikawa ..... 345/87
6,873,319 B2 * 3/2005 Inoue et al. ..... 345/204
2003/0117362 A1 * 6/2003 An ..... 345/98

* cited by examiner

*Primary Examiner*—Richard Hjerpe
*Assistant Examiner*—Tom V Sheng
(74) *Attorney, Agent, or Firm*—William B. Kempler; Wade J. Brady, III; Frederick J. Telecky, Jr.

(57) ABSTRACT

An integrated circuit is provided for scan driving that can significantly reduce the chip size. In first region AODD, odd-numbered output pads OUT1, OUT3, . . . OUT173, OUT175, driver circuits DR1, DR3, . . . DR173, DR175, and flip-flops SREG1, SREG3, . . . SREG173, SREG175 in an order corresponding to the order of the odd-numbered scanning lines are each arranged as a column in the X-direction, and, at the same time, output pads OUTi, driver circuits DRi and flip-flops SREGi corresponding to the scanning lines are arranged in the same row in the Y-direction (chip width direction). In second region AEVEN, even-numbered output pads OUT2, OUT4, . . . OUT174, OUT176, driver circuits DR2, DR4, . . . DR174, DR176, and flip-flops SREG2, SREG4, . . . SREG174, SREG176 in an order corresponding to the order of the even-numbered scanning lines are each arranged as a column in the X-direction, and, at the same time, output pads OUTi, driver circuits DRi and flip-flops SREGi corresponding to the scanning lines are arranged in the same row in the Y-direction (chip width direction).

13 Claims, 10 Drawing Sheets

INTEGRATED CIRCUIT FOR SCAN DRIVING

RELATED APPLICATION

The present application is based on priority of Japanese Patent Application No. 2002-348991, filed on Nov. 29, 2002.

FIELD OF THE INVENTION

The present invention pertains to an integrated circuit (IC or LSI) for scan driving used in flat panel displays, etc. Especially, this invention pertains to a technology for improvement of the circuit configuration on a chip.

BACKGROUND OF THE INVENTION

For a liquid crystal display, organic EL display, or other flat panel display, plural scanning lines and plural signal lines are arranged crossing each other in a matrix configuration, and a pixel is arranged at each cross point of the matrix. By means of a scan driver LSI, the scanning lines are selected and driven in a line-sequential scheme. By means of a signal driver LSI, a display signal voltage (image information) is applied or written on each pixel on each selected scanning line so as to display an image.

FIGS. 5-7 illustrate an example of an organic EL display for a mobile phone (cell phone), etc. FIG. 5 is a front view of the display. FIG. 6 is a side view. FIG. 7 is a back view.

On said organic EL display 100, due to restriction of the assembly space, controller 106 for image display is arranged on printed board 104 on the back of display panel 102 by means of PCB (Print Circuit Board) assembly, and, at the same time, by means of TCP (Tape Carrier Package) assembly, scan driver LSI 108 and signal driver LSI 110 are arranged on films 112, 114, respectively, between printed board 104 and panel 102. For controller 106, one may also adopt FPC (Flexible Printed Circuit) assembly instead PCB assembly.

In consideration of the efficiency of laying wiring from scan driver LSI 108 and the restriction of the panel terminal pitch, the scan drive terminals ROWn connected to the scanning lines (not shown in the figure) on panel 102 can be divided into odd-numbered and even-numbered, and they are arranged on the left and right sides of panel 102, respectively. For example, the odd-numbered terminals ROW 2j-1 (j=1, 2, 3 . . . ) are on the left side of panel 102, while the even-numbered terminals ROW 2j are on the right side of panel 102. More specifically, if 176 scanning lines are provided, for example, on panel 102, as shown in FIGS. 5 and 7, along the left edge (or the right edge when viewed from the inner side) of panel 102, 88 odd-numbered scan drive terminals ROW1, ROW3, . . . ROW173, ROW175 are arranged as a longitudinal column, and, at the same time, along the right edge (or the left edge when viewed from the inner side) of panel 102, 88 even-numbered scan drive terminals ROW2, ROW4, . . . ROW174, ROW176 are arranged as a longitudinal column.

Also, signal drive terminals COL m connected to the signal lines (not shown in the figure) of panel 102 are arranged as a lateral row along the upper edge or the lower edge of panel 102. In this example, 432 signal drive terminals COL1, COL2, COL3, . . . COL431, COL432 are arranged corresponding to 432 signal lines.

As shown in FIG. 7, for scan driver LSI 108, too, TCP output terminals (leads) ROW1, ROW2, ROW3, . . . ROW174, ROW175, ROW176 are divided into odd-numbered output terminals (ROW1, ROW3, . . . ROW173, ROW175 and even-numbered output terminals (ROW2, ROW4, . . . ROW174, ROW176, and these two portions each are arranged as a column on the left and right sides, respectively. In this way, wiring to the odd-numbered scan drive terminals set along the left edge of the panel and wiring to the even-numbered scan drive terminals set along the right edge of the panel can be laid without crossing each other and at a high efficiency.

FIG. 8 is a diagram illustrating the configuration of terminals on the chip for scan driver LSI 108. As shown in the figure, said LSI 108 has a rod-shaped structure favorable to TCP. Along one edge extending in the longitudinal direction of the chip, the input terminals or pads (VSSOLED, VOLED, Vss, STV, . . . ) are arranged as a column. Along the opposite edge, output terminals or pads OUT1, OUT3, . . . OUT173, OUT175, OUT176, OUT174, . . . OUT4, OUT2 are arranged as a column.

As the principal input terminals or pads pertaining to this invention, VSSOLED and VOLED are terminals that take the driving L-level voltage (such as 0 V) and H-level voltage (such as 15 V) input to them from the power source circuit (not shown in the figure), respectively. $V_{SS}$ and $V_{DD}$ are terminals that have logic L-level voltage (such as 0 V) and H-level voltage (such as 3.3 V) input to them from the power source circuit, respectively. STV is a terminal that has the timing pulse indicating start of the frame or start pulse STV input to it from controller 106. L/R is a terminal that has control signal LR indicating the scanning order or scanning direction (forward/backward) of the scanning lines input to it from controller 106. CPV is a terminal that has clock CPV defining the line-sequential cycle for line-sequentially scanning the scanning lines input to it from controller 106.

The output terminal or pad group is divided into two types, that is, odd-numbered type OUT1, OUT3, . . . OUT173, OUT175 and even-numbered type OUT2, OUT4, . . . OUT174, OUT176, and they are [each] arranged as a column. The odd-numbered output pads OUT1, OUT3, . . . OUT173, OUT175 are arranged as a column in an order corresponding to said odd-numbered TCP output leads (ROW1, ROW3, . . . ROW173, ROW175. More specifically, the first output pad OUT1 is arranged at one end of the chip. Then, the third and later odd-numbered output pads OUT3, . . . OUT173, OUT175 are arranged in rising order with a prescribed spacing between them in the longitudinal direction (X-direction) of the chip. On the other hand, even-numbered output pads OUT2, OUT4, . . . OUT174, OUT176 are arranged as a column in an order corresponding to said even-numbered TCP output leads (ROW2, ROW4, . . . ROW174, ROW176. More specifically, the second output pad OUT2 is arranged on the other end of the chip. Then, the fourth and later even-numbered output pads OUT4, . . . OUT174, OUT176 are arranged as a column in rising order with a prescribed spacing between them in the longitudinal direction (X-direction) of the chip.

FIG. 9 is a diagram illustrating the circuit constitution and layout of the main portion of scan driver LSI 108. FIG. 10 is a diagram illustrating in detail the circuit constitution and layout of FIG. 9.

As shown in FIG. 10, drive section 122 is arranged in the former section of output pad group 120, and selection section 124 is arranged in the former section of drive section 122. Drive section 122 has driver circuits DRi composed of decoders DECi and output buffers OUTBUFi corresponding to output pads OUTi (i=1, 2 , . . . 176, respectively. Selection section 124 has a shift register SR composed of flip-flops SREGi corresponding to various driver circuits DRi.

As far as the layout is concerned, odd-numbered output pad group OUT1, OUT3, . . . OUT173, OUT175 and even-numbered output pad group OUT2, OUT4, . . . OUT174, OUT176 are arranged at positions corresponding or opposite each other. In drive section 122, too, odd-numbered driver circuits DR1, DR3, . . . DR173, DR175 and even-numbered driver circuits DR2, DR4, . . . DR174, DR176 are arranged as two groups in the layout. By virtue of this layout of the odd-numbered and even-numbered types, the Nth output pad OUTi and the Nth driver circuit DRi are arranged in the same row in the Y-direction. Consequently, the output terminals of driver circuits DR1, DR3, . . . DR173, DR175, DR176, DR174, . . . DR4, DR2 are connected by wiring to output pads OUT1, OUT3, . . . OUT173, OUT175, OUT176, OUT174, . . . OUT4, OUT2 in parallel and free of crossing of wiring between each other.

On the other hand, flip-flops SREG1, SREG2, SREG3, . . . SREG174, SREG175, SREG176 of selection section 124 are not divided into odd-numbered and even-numbered types. Instead, from the first flip-flop SREG1 to the $176^{th}$ flip-flop SREG176, they are arranged in increasing order as a column in the X-direction. Consequently, the output terminals of flip-flops SREG1, SREG2, SREG3, . . . SREG174, SREG175, SREG176 are connected by wiring to the input terminals of driver circuits DR1, DR2, DR3, . . . DR174, DR175, DR176 with wires crossing each other appropriately by means of a laminated wiring structure.

In this example, because the scanning lines are driven with respect to 3-value levels, that is, L-level, H-level, and HZ (high-impedance) level (high-resistance output H-level), three driving elements, such as driving transistors (not shown in the figure), are arranged in output buffer OUTBUFi of each driver circuit DRi. In order to turn on one of the three drive transistors in a selective way, three output terminals are arranged on decoder DECi, and three input terminals are arranged on output buffer OUTBUFi, respectively. Also, in order to get the timing needed for switching of said 3-value levels, not only the principal input terminal of decoder DECi is connected by wiring to the output terminal of the corresponding flip-flop SREGi, but the output terminals of adjacent flip-flops SREGi−1 and SREGi+1 are also connected by wiring to the input terminal for backward-direction selection of decoder DECi (LR=R) and the input terminal for forward-direction selection (LR=L).

Shift register SR of selection section 124 has a bidirectional data shift function. Start pulse STV indicating the start timing of the frame by controller 106 is selectively input corresponding to the scanning direction (forward/backward direction) to the data input terminals of flip-flops SREG1 and SREG176 at the two ends, respectively. The inverted output of adjacent flip-flop SREGi−1 or the inverted output of flip-flop SREGi+1 is selectively input to the data input terminal of each flip-flop SREGi except the two ends, depending on the scanning direction (forward/backward direction) through inverter INV. All of flip-flops SREG1, SREG2, SREG3, . . . SREG176 each have control signal LR indicating the scanning direction from controller 106 (forward/backward direction) input to the control terminal or the annexed controller, and, have the shift pulse or synchronization clock signal CPV having frequency of the line-sequential cycle input to the clock terminal.

FIG. 11 is a timing chart illustrating the waveforms or timing of the signals in the various parts in the circuit constitution shown in FIGS. 9 and 10. The examples shown in the figures are in the case in which the scanning direction is selected to forward-direction (LR=L).

At the start of each frame, H-level start pulse STV is input from controller 106 to first flip-flop SREG1 of selection section 124, at rise (CPV=1) of clock signal CPV, said start pulse STV is loaded or latched as shift data in flip-flop SREG1, and the output of flip-flop SREG1 is changed from H-level, which has been held up to this point, to L-level.

As the output of first flip-flop SREG1 is changed from H-level to L-level, corresponding to this change, the output of first driver circuit DR1 is also changed from inactive HZ-level, that is, the high-impedance H-level (15V), which has been held to this point, to active L-level (0 V). The drive voltage of said L-level selectively drives the first scanning line through output pad OUT1 and scan drive terminal ROW1. Here, the high-impedance H-level (15 V) means that a voltage of 15 V is output at a resistance as high as several MΩ. Also, H-level and L-level refer to outputs with a low resistance. On the other hand, the output of flip-flop SREG1 (L-level) is logically inverted by inverter INV, and it is then sent as the H-level shift data to the data input terminal of second flip-flop SREG2.

In the next clock cycle, when CPV rises (CPV=2), corresponding to this change, second flip-flop SREG2 latches the shift data from the preceding stage SREG1, and its output is changed from H-level, which has been held to this point, to L-level. For the flip-flops other than SREG2, L-level is latched at rise of CPV (CPV=2). Especially, the output of first flip-flop SREG1 returns from L-level, which has been held to this point, to H-level.

When the output of second flip-flop SREG2 is changed from H-level to L-level, corresponding to this change, the output of second driver circuit DR2 is also changed from inactive HZ-level, which has been kept to this point, to active L-level. The L-level drive voltage (0 V) selectively drives the second scanning line through output pad OUT2 and scan drive terminal ROW2. On the other hand, the output (L-level) of flip-flop SREG2 is logically inverted by inverter INV, and it is then sent as H-level shift data to the data input terminal of third flip-flop SREG3. Also, as a response to the change of the output of flip-flop SREG2 of the next stage from H-level to L-level, first driver circuit DR1 switches the drive voltage output to output pad OUT1 from the active L-level (0 V), which has been held until this point, to inactive H-level (15 V).

In the next clock cycle, as CPV rises (CPV=3), corresponding to this change, third flip-flop SREG3 latches the shift data from SREG2 of the preceding stage, and its output is changed from H-level, which has been held to this point, to L-level. For the flip-flops other than SREG3, L-level is latched at the rise of CPV (CPV=3). The output of second flip-flop SREG2 returns from L-level, which has been held until this point, to H-level.

When the output of third flip-flop SREG3 is changed from H-level to L-level, corresponding to this change, the output of third driver circuit DR2 is changed from inactive HZ level, which has been held until this point, to active L-level. The L-level drive voltage (0 V) selectively drives the third scanning line via output pad OUT3 and scan drive terminal ROW3. On the other hand, the output (L-level) of flip-flop SREG3 is logically inverted by inverter INV, and it is then sent as H-level shift data to the data input terminal of fourth flip-flop SREG4. Also, when the output of flip-flop SREG3 of the next stage is changed from H-level to L-level, second driver circuit DR2 has its output drive voltage return from active L-level to inactive H-level. Also, as a response to restoring the output of flip-flop SREG2 of the next stage from L-level to H-level, first driver circuit DR1 switches the output drive voltage from H-level to HZ-level.

In the later clock cycles, the same operation as described above is repeated for flip-flops SREG and driver circuits DR of the later stages. As a result, during one frame period, one by one, all of the scanning lines on panel 102 are sequentially driven selectively from the upper side or from the lower side in line-sequential cycles.

As already mentioned, between selection section 124 and drive section 122 in conventional scan driver LSI 108, the output terminals of flip-flops SREG1, SREG2, SREG3, . . . SREG174, SREG175, SREG176 extend in the X-direction and the Y-direction while their wiring lines cross one another in complicated ways, and they are connected by wiring to the input terminals of driver circuits DR1, DR2, DR3, . . . DR174, DR175, DR176. Consequently, size S of the wiring region in the Y-direction has to be rather large. Also, in order to control switching of the aforementioned 3-value output and scanning direction (forward/backward directions), three input terminals are arranged on each decoder DECi of each driver circuit DRi. In this case, the number of wires between selection section 124 and drive section 122 is tripled, and wiring region size S is doubled.

In this way, because the wiring region between selection section 124 and drive section 122 has a large size, the size of the chip in the Y-direction (chip width) becomes larger, and the chip area becomes larger. This is a problem.

In said conventional circuit constitution, it is believed that if decoders DEC1, DEC2, DEC3, . . . DEC174, DEC175, DEC176 of driver circuits DR1, DR2, DR3, . . . DR174, DR175, DR176 are arranged in the same order and in the same row with respect to flip-flops SREG1, SREG2, SREG3, . . . SREG174, SREG175, SREG176, one can change the shape and reduce the size S of the wiring region between them. However, even in this case, in order to compensate for the difference in the arrangement order between decoders DEC1, DEC2, DEC3, . . . DEC174, DEC175, DEC176 and output buffers OUTBUF1, OUTBUF3, . . . OUTBUF173, OUTBUF175, OUTBUF176, OUTBUF174, . . . OUTBUF4, OUTBUF2), plural wires have to be laid crossing each other in the X-direction and the Y-direction. As a result, in this case, it is necessary to set a large wiring region size in the Y-direction, and there is little change in the overall size of the chip.

Also, as shown in FIG. 12, the following layout has been proposed: Odd-numbered flip-flops SREG1, SREG3, . . . SREG173, SREG175 and even-numbered flip-flops SREG2, SREG4, . . . SREG174, SREG176 are arranged facing each other in the central portion; in an order corresponding to the order of odd-numbered flip-flops SREG1, SREG3, . . . SREG173, SREG175, odd-numbered decoders DEC1, DEC3, . . . DEC173, DEC175, odd-numbered output buffers OUTBUF1, OUTBUF3, . . . OUTBUF173, OUTBUF175, and odd-numbered output pads OUT1, OUT3, . . . OUT173, OUT175 are arranged on the right side, and, in an order corresponding to the order of even-numbered flip-flops SREG2, SREG4, . . . SREG174, SREG176, even-numbered decoders DEC2, DEC4, . . . DEC174, DEC176, even-numbered output buffers OUTBUF2, OUTBUF4, . . . OUTBUF174, OUTBUF176, and even-numbered output pads OUT2, OUT4, . . . OUT174, OUT176 are arranged on the left side.

In the layout shown in FIG. 12, there is no need to have a large wiring region having plural wires crossing each other in a complicated way, and it is possible to halve the size in the X-direction. However, the size in the Y-direction is doubled. Also, in TCP, the size in the Y-direction (chip width) may be in the longitudinal direction of the tape, and the increase in the chip size in the longitudinal direction of the tape hampers winding-up of the tape reel (the chip is prone to breakage). Consequently, it is inappropriate for practical application.

The purpose of this invention is to solve the aforementioned problems of the prior art by providing an integrated circuit for scan driving that can significantly reduce the chip size.

SUMMARY OF THE INVENTION

In order to realize the aforementioned purpose, this invention provides an integrated circuit for scan driving characterized by the following facts: the integrated circuit for scan driving is used in sequentially selecting and driving scanning lines in a display, which has said plural scanning lines and plural signal lines arranged crossing each other in a matrix configuration, and which has a pixel arranged at each cross point; in this integrated circuit for scan driving, on a chip, there are plural output pads arranged as a column in a first direction, plural driver circuits for driving said signal lines to the active state through said output pads, respectively, and plural selection circuits for individually selecting said driver circuits in a line-sequential scanning cycle in an order corresponding to the order of said signal lines; on said chip, the odd-numbered output pads, driver circuits and selection circuits corresponding to odd-numbered scanning lines are all arranged in a first region, while the even-numbered output pads, driver circuits and selection circuits corresponding to the even-numbered scanning lines are all arranged in a second region adjacent to said first region in said first direction; in said first region, in an order corresponding to the order of said odd-numbered signal lines, said odd-numbered output pads, driver circuits and selection circuits are arranged as columns in said first direction, respectively, and, at the same time, said output pads, driver circuits and selection circuits corresponding to the scanning lines are arranged in the same row in the second direction nearly orthogonal to said first direction; and, in said second region, in an order corresponding to the order of said even-numbered signal lines, said even-numbered output pads, driver circuits and selection circuits are arranged as columns in said first direction, respectively, and, at the same time, said output pads, driver circuits and selection circuits corresponding to the signal lines are arranged in the same row in said second direction.

In the integrated circuit for scan driving, in the first and second regions, driver circuits and selection circuits corresponding to the output pads are arranged in the same row in the second direction. As a result, it is possible to connect the output pads and the driver circuits, as well as the driver circuits and the selection circuits, by wires that extend in the second direction. In the second direction, it is possible to reduce the wiring region size significantly, and it is possible to significantly reduce the chip size.

As a preferred embodiment of this invention, said odd-numbered selection circuits are made of individual flip-flops that overall form the first shift register; the first shift data provided by the frame period is transferred sequentially to the latter-stage flip-flops in synchronization with the first transfer clock signal at a frequency half that of the line-sequential scanning cycle; by means of the output signals of the flip-flops with said first shift data latched in them, the corresponding driver circuits are selected; said even-numbered selection circuits are made of individual flip-flops that overall form the second shift register; the second shift data provided by the frame period is transferred sequentially to the latter-stage flip-flops in synchronization with the second transfer clock signal at a frequency half that of the line-sequential scanning cycle and in a phase opposite to that of said first transfer clock signal; and, by means of the output signals of the flip-flops with said second shift data latched in them, the corresponding driver circuits are selected. In this case, said first and second shift registers may also allow bidirectional transfer of, respectively, said first and second shift data.

As another preferred embodiment of this invention, the integrated circuit for scan driving has a transfer clock generator that divides for the fundamental clock signal that defines the cycle of line-sequential scanning in half, and a shift data generator that generates said first and second shift data in two consecutive cycles of said fundamental clock signal corresponding to the start pulse that indicates the timing of the start of a frame.

As yet another preferred embodiment of this invention, said first direction corresponds to the longitudinal direction of said chip, and said output pads are arranged as a column along one edge extending in the longitudinal direction of said chip. In this case, the input pads for input of the desired power source voltage or signal may be set as a column along the other edge in the longitudinal direction of said chip.

As another preferred embodiment of this invention, said chip is assembled by means of TCP.

Another integrated circuit for scan driving of the present invention is characterized by the following facts: the integrated circuit for scan driving is for sequentially supplying scan drive signals to the scanning electrodes of a display device; in this integrated circuit for scan driving, there are the following parts: a first shift register, which has plural register circuits connected in series, and which sequentially transfers the first shift data corresponding to the first clock signal, a first drive section, which has plural driver circuits corresponding to the plural register circuits of said first shift register, respectively, and which has said plural driver circuits output drive signals corresponding to said first shift data output from the plural register circuits of said first shift register, respectively, a second shift register, which has plural register circuits connected in series, and which sequentially transfers the second shift data shifted in phase by half a period of said second clock signal with respect to said first shift data corresponding to the second clock signal with its phase deviated by 180° from said first clock signal, and a second drive section, which has plural driver circuits corresponding to the plural register circuits of said second shift register, respectively, and which has said plural driver circuits output drive signals corresponding to said second shift data output from the plural register circuits of said second shift register, respectively; said drive signals are output alternately from the various driver circuits of said first drive section and the various driver circuits of said second drive section corresponding to said first or second shift data.

REFERENCE NUMERALS AND SYMBOLS AS SHOWN IN THE DRAWINGS

In the figures, 10 represents an output pad section, 12 represents a drive section, 14 represents a selection section, 16 represents a generator, 18 represents a shift data generator, 20 represents a transfer clock generator, SR-O represents a first shift register, SR-E represents a second shift register, SREG1, SREG3, . . . SREG173, SREG175 represents an odd-numbered flip-flop, SREG2, SREG4, . . . SREG174, SREG176 represents an even-numbered flip-flop, DR1, DR3, . . . DR173, DR175 represents an odd-numbered driver circuit, DR2, DR4, . . . DR174, DR176 represents an even-numbered driver circuit, DEC1, DEC3, . . . DEC173, DEC175 represents an odd-numbered decoder, DEC2, DEC4, . . . DEC174, DEC176 represents an even-numbered decoder, OUTBUF1, OUTBUF3, . . . OUTBUF175 represents an odd-numbered output buffer, OUTBUF2, OUTBUF4, . . . OUTBUF176 represents an even-numbered output buffer, OUT1, OUT3, . . . OUT173, OUT175 represents an odd-numbered output pad, OUT2, OUT4, . . . OUT174, OUT176 represents an even-numbered output pad, 106 represents a controller, ROW1, ROW3, . . . ROW173, ROW175 represents an odd-numbered scan drive terminal, and ROW2, ROW4, . . . ROW174, ROW176 represents an even-numbered scan drive terminal

DESCRIPTION OF THE EMBODIMENTS

In the following, preferred embodiments of this invention will be explained with reference to FIGS. 1-4.

Figure 8:
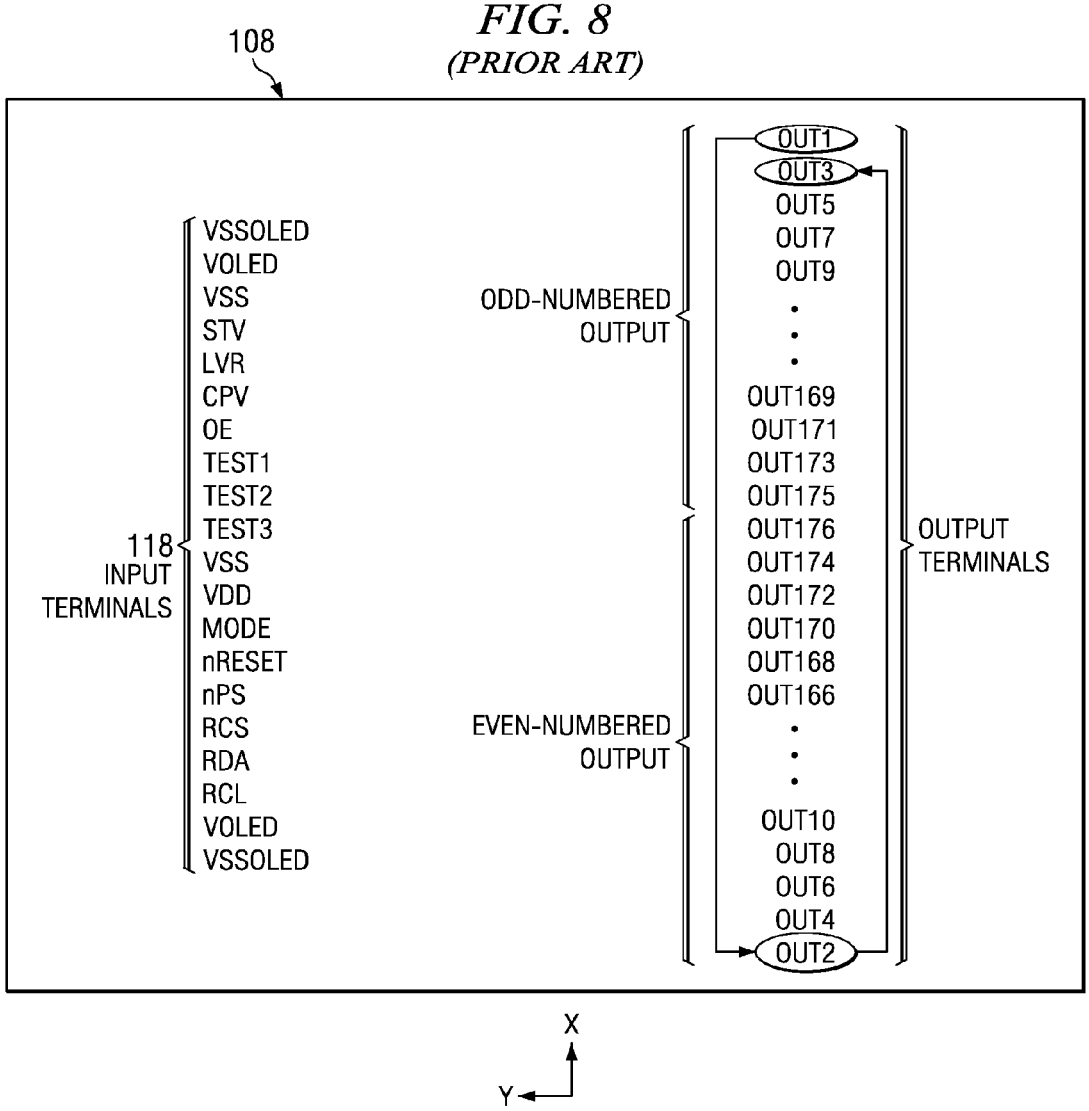
FIG. 8 (PRIOR ART)
FIG. 8 is a plane view illustrating the terminal layout on the scan driver LSI.

The scan driver LSI in this embodiment is mainly characterized by features in the circuit configuration or layout on the chip, while it has the same appearance and external functions of the chip as those in the prior art. Consequently, for the scan driver LSI in this embodiment, one may also adopt the constitution as a slim chip for TCP as shown in FIG. 8, that is, the input terminals or pads VSSOLED, VOLED, Vss, STV, . . . are arranged as a column along one edge in the longitudinal direction of the chip, and, along the opposite edge, output terminals or pads OUT1, OUT3, . . . OUT173, OUT175, OUT176, OUT174, . . . OUT4, OUT2 are arranged as a column. That is, the output pad group is divided into two types, that is, the odd-numbered type OUT1, OUT3, . . . OUT173, OUT175 and the even-numbered type OUT2, OUT4, . . . OUT174, OUT176, and they are [each] arranged as a column. More specifically, for the odd-numbered output pads OUT1, OUT3, . . . OUT173, OUT175, the first output pad OUT1 is arranged at one end of the chip. Then, the third and later odd-numbered output pads OUT3, . . . OUT173, OUT175 are arranged in rising order with a prescribed spacing between them in the longitudinal direction (X-direction) of the chip. On the other hand, for even-numbered output pads OUT2, OUT4, . . . OUT174, OUT176, the second output pad OUT2 is arranged on the other end of the chip. Then, the fourth and later even-numbered output pads OUT4, . . . OUT174, OUT176 are arranged as a column in rising order with a prescribed spacing between them in the longitudinal direction (X-direction) of the chip.

Figure 5:
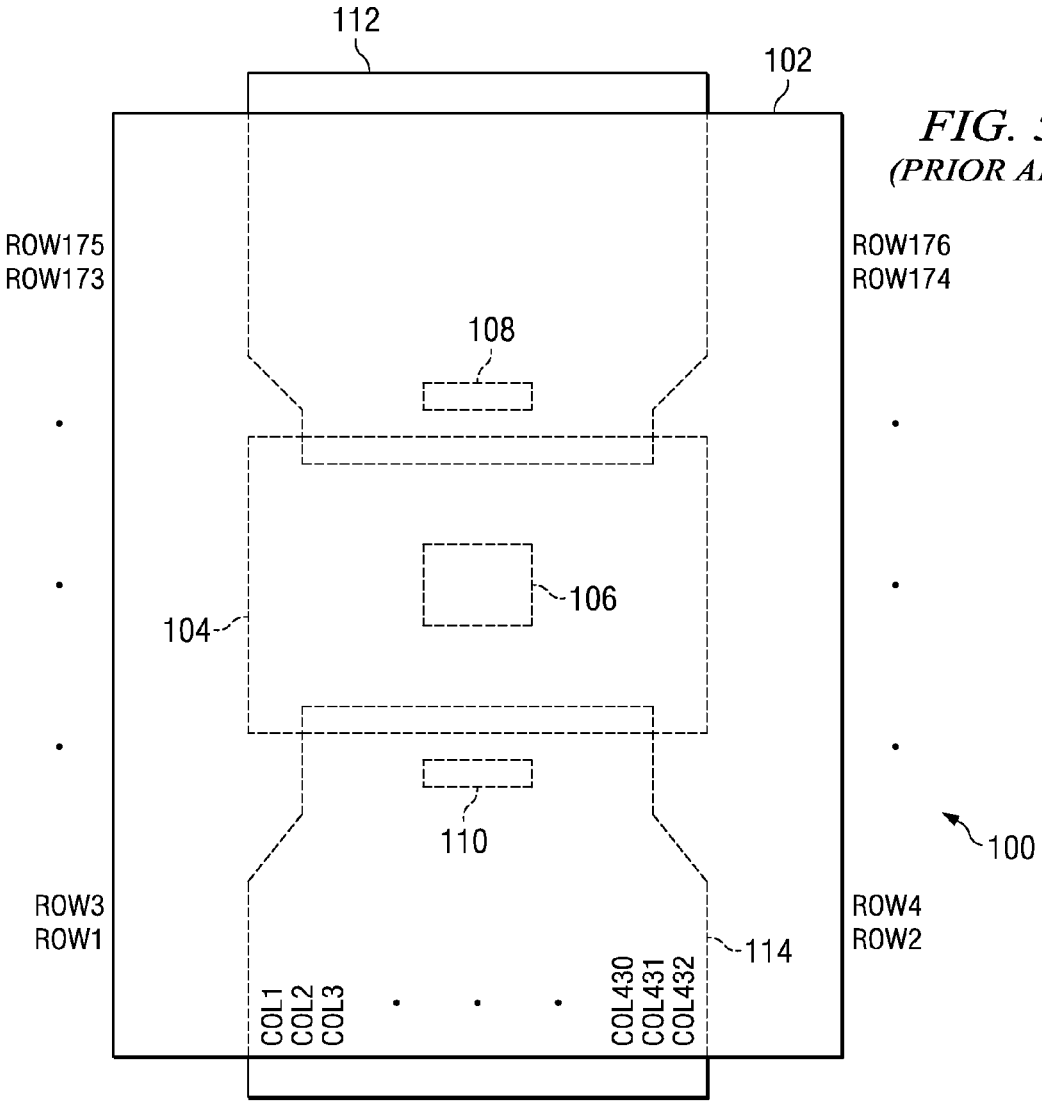
FIG. 5 (PRIOR ART)
FIG. 5 is a front view illustrating an example of constitution of the organic EL display panel.
Figure 6:
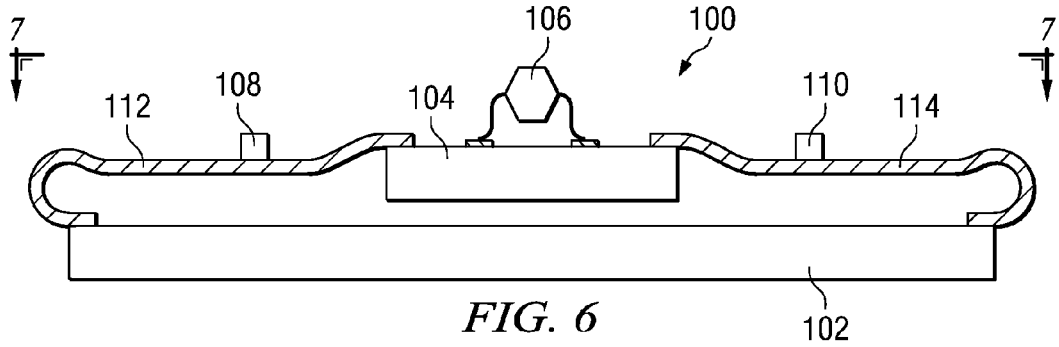
FIG. 6 (PRIOR ART)
FIG. 6 is a side view illustrating the constitution of the panel shown in FIG. 5.
Figure 7:
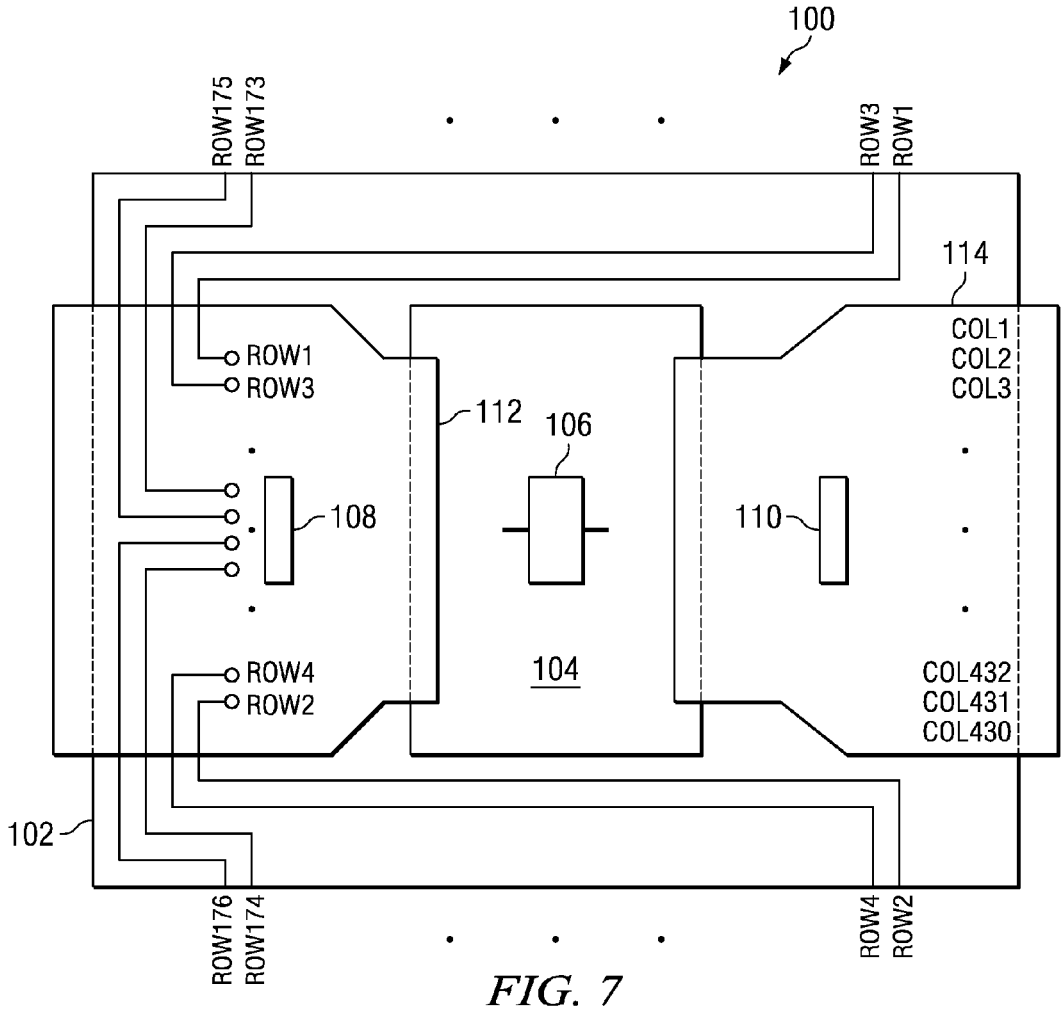
FIG. 7 (PRIOR ART)
FIG. 7 is a back view illustrating the constitution of the panel shown in FIG. 5.

In the following explanation, scan driver LSI 108 of the prior art in the organic EL display shown in FIGS. 5-7 will be replaced by the scan driver LSI of this embodiment for explanation.

Figure 1:
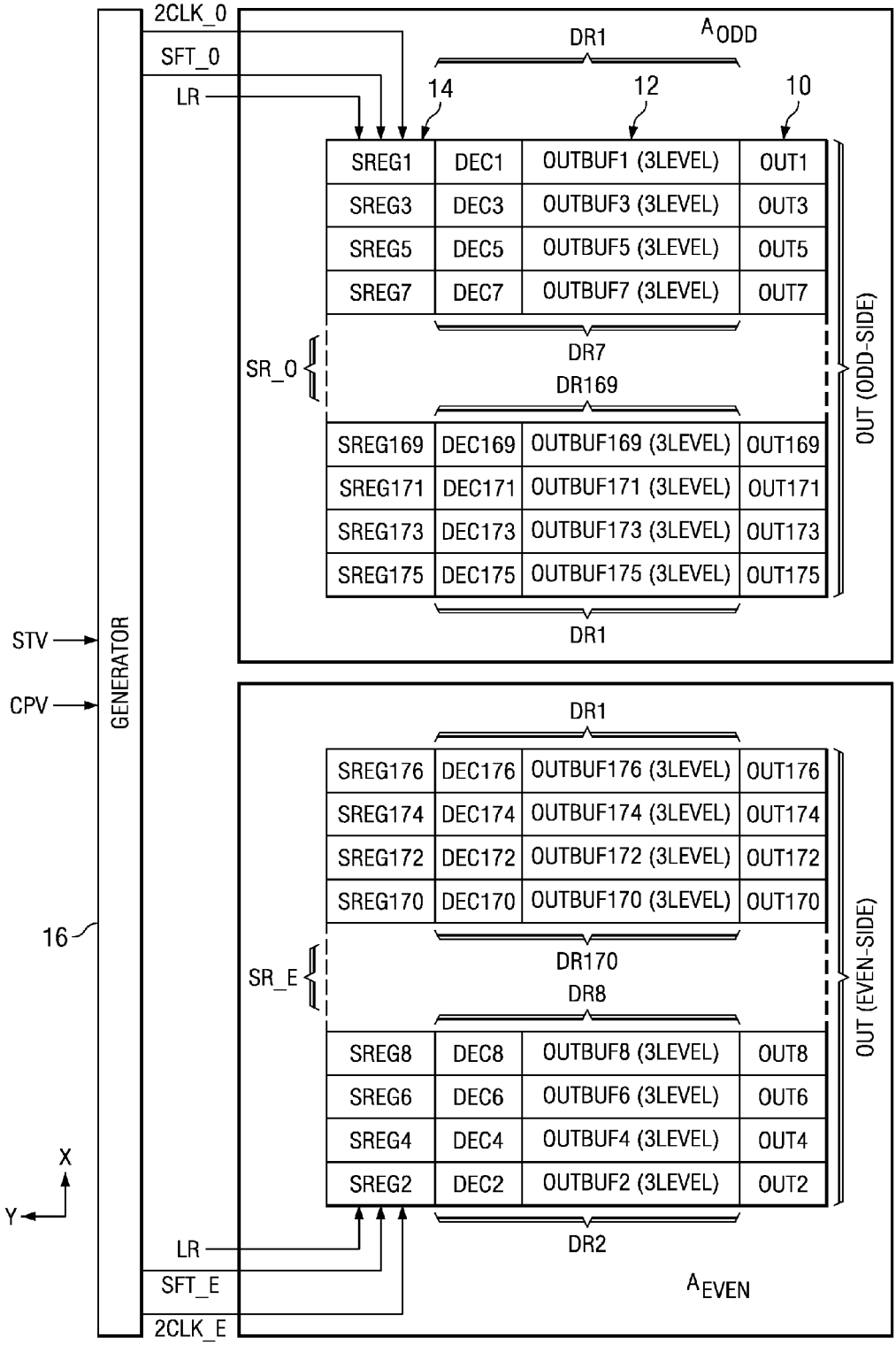
FIG. 1 is a block diagram illustrating the circuit configuration and layout of the main portion of the scan driver LSI in an embodiment of this invention.
Figure 2:
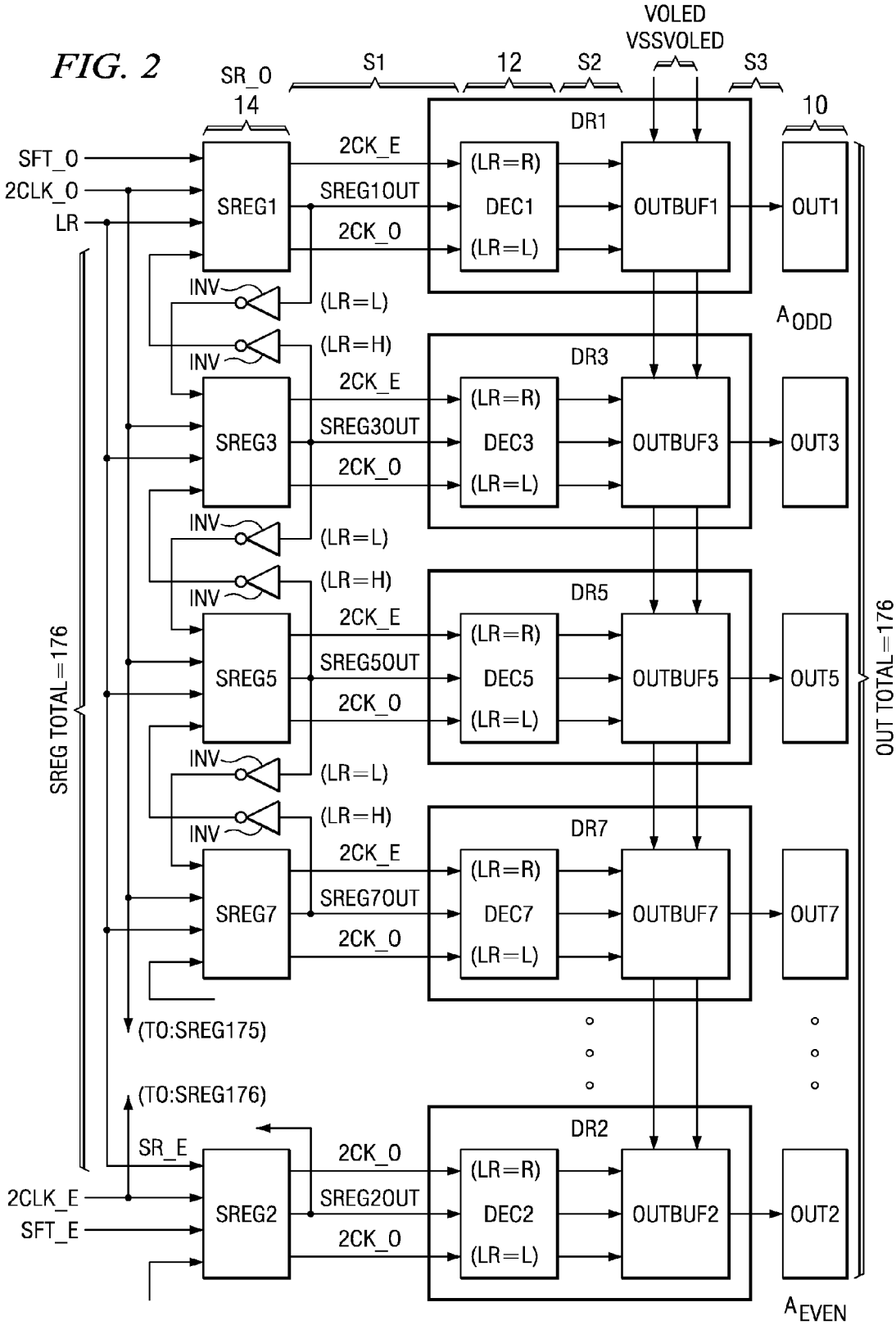
FIG. 2 is a block diagram illustrating in detail the circuit configuration and layout of FIG. 1.

FIG. 1 is a diagram illustrating the circuit constitution and layout of the main portion of the scan driver LSI in an embodiment of this invention. FIG. 2 is a diagram illustrating in detail the circuit constitution and layout shown in FIG. 1.

As shown in FIG. 1, drive section 12 in this embodiment is arranged in the former area of output pad section 10, and selection section 14 is arranged in the former section of drive section 12 on the chip.

In the layout, two regions $A_{ODD}$ and $A_{EVEN}$ adjacent to each other in the chip's longitudinal direction (X-direction) are arranged. Odd-numbered output pads OUT1, OUT3, . . . OUT173, OUT175, driver circuits DR1, DR3, . . . DR173, DR175 and flip-flops SREG1, SREG3, . . . SREG173, SREG175 corresponding to the odd-numbered scanning lines are all arranged in said first region $A_{ODD}$, while even-numbered output pads OUT2, OUT4, . . . OUT174, OUT176, driver circuits DR2, DR4, . . . DR174, DR176 and flip-flops SREG2, SREG4, . . . SREG174, SREG176 corresponding to the even-numbered scanning lines are all arranged in said second region $A_{EVEN}$. Here, driver circuits DRi (i=1, 2, 3, . . . 176) each have decoder DECi and output buffer OUTBUFi. Output buffer OUTBUFi contains a level shifter for converting the voltage level (such as 3.3 V) for logic to the voltage level (such as 15 V) for driving, and one or several driving elements, such as driving transistors, etc., for driving the signal lines at a prescribed drive voltage.

In first region $A_{ODD}$, odd-numbered output, pads OUT1, OUT3, . . . OUT173, OUT175, driver circuits DR1, DR3, . . . DR173, DR175, and flip-flops SREG1, SREG3, . . . SREG173, SREG175 in an order corresponding to the order of the odd-numbered scanning lines are each arranged as a column in the X-direction, and, at the same time, output pads OUTi, driver circuits DRi and flip-flops SREGi corresponding to the scanning lines are arranged in the same row (as a column) in the Y-direction (chip width direction). Flip-flops SREG1, SREG3, . . . SREG173, SREG175 overall form one shift register SR-O.

In second region $A_{EVEN}$, even-numbered output pads OUT2, OUT4, . . . OUT174, OUT176, driver circuits DR2, DR4, . . . DR174, DR176, and flip-flops SREG2, SREG4, . . . SREG174, SREG176 in an order corresponding to the order of the even-numbered scanning lines are each arranged as a column in the X-direction, and, at the same time, output pads OUTi, driver circuits DRi and flip-flops SREGi corresponding to the scanning lines are arranged in the same row (as a column) in the Y-direction (chip width direction). Flip-flops SREG2, SREG4, . . . SREG174, SREG176 overall form one shift register SR-E.

In this embodiment, generator 16 is provided. Start pulse STV that indicates timing of start of the frame and the shift pulse or synchronization clock signal CPV having the frequency of the line-sequential cycle are sent from controller 106 (FIGS. 4 and 6) to this generator 16. For example, start pulse STV is sent as an H-level pulse signal having a pulse width of 1 cycle of clock signal CPV.

Figure 3:
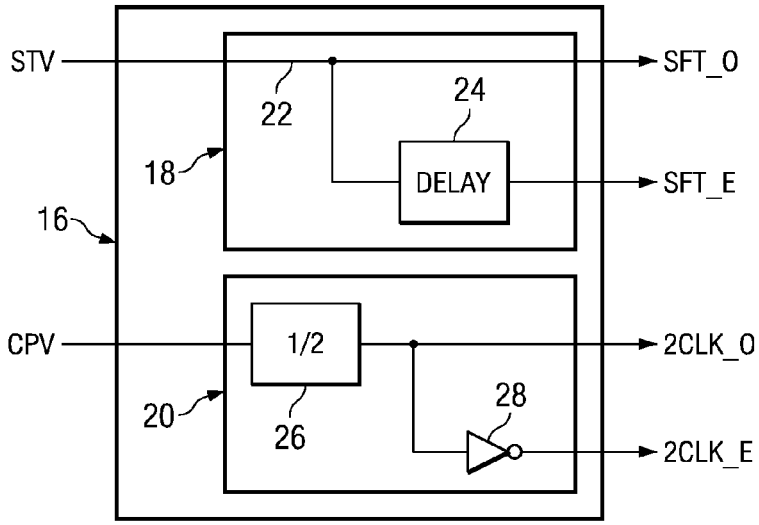
FIG. 3 is a block diagram illustrating an example of the circuit configuration of the shift data generator and transfer clock generator in the embodiment.

Generator 16 has shift data generator 18 and transfer clock generator 20 as shown in FIG. 3. Shift data generator 18 has through-transfer circuit 22 and delay circuit 24. Through-transfer circuit 22 outputs the input start pulse STV directly as the first shift data SFT-O for odd-numbered use. Delay circuit 24 delays through-pulse STV by the time of a clock cycle, and outputs the delayed signal as second shift data SFT-E for even-numbered use. Also, one may make use of a one-shot circuit in place of delay circuit 24.

Transfer clock generator 20 has ½ frequency divider 26 and inverter 28. ½ frequency divider 26 divides the frequency of input clock signal CPV in half, and outputs the obtained signal as the first transfer clock signal or shift pulse 2CLK-O. Inverter 28 logically inverts the output (2CLK-O) of ½ frequency divider 26, and outputs the obtained signal as the second transfer clock signal or shift pulse 2CLK-E.

Among the signals output from generator 16, first shift data SFT-O is selectively input to the data input terminals of flip-flops SREG1, SREG175 at the two ends among the odd-numbered flip-flops SREG1, SREG3, . . . SREG173, SREG175 arranged in first region $A_{ODD}$, corresponding to the scanning direction (forward/backward). On the other hand, second shift data SFT-E is selectively input to the data input terminals of flip-flops SREG2, SREG176 at the two ends among the even-numbered flip-flops SREG2, SREG4, . . . SREG174, SREG176 arranged in second region $A_{EVEN}$, corresponding to the scanning direction (forward/backward).

Also, first shift pulse 2CLK-O is input to the clock terminals of odd-numbered flip-flops SREG1, SREG3, . . . SREG173, SREG175 in first region $A_{ODD}$. On the other hand, second shift pulse 2CLK-E is input to the clock terminals of even-numbered flip-flops SREG12 SREG4, . . . SREG174, SREG176 in second region $A_{EVEN}$.

In this embodiment as well, because the scanning lines are driven with respect to 3-value levels, that is, L-level, H-level, and HZ (high-impedance) level, in output buffer OUTBUFi of each driver circuit DRi, three drive elements, such as drive transistors (not shown in the figure), are provided. In order to turn on one out of the three drive transistors in a selective way, three output terminals are arranged on decoder DECi, and three input terminals are arranged on output buffer OUTBUFi, respectively.

Also, in order to get the timing needed for switching said 3-value levels, not only the principal input terminal of decoder DECi is connected by wiring to the output terminal of the corresponding flip-flop SREGi, but clock signals 2CK-O, 2CK-E corresponding to said first shift pulse 2CLK-O and second shift pulse 2CLK-E are also connected by wiring to the input terminal for backward-direction selection of decoder DECi (LR=R) and the input terminal for forward-direction selection (LR=L). As shown in FIG. 2, in which the detailed constitution is omitted, near each flip-flop SREGi, circuits or wiring are arranged for transferring first shift pulse 2CLK-O and second shift pulse 2CLK-E as through [signals] from generator 16 to the corresponding decoder DECi.

In first region $A_{ODD}$, shift register SR-O has a bidirectional data shift function. The inverted output of adjacent flip-flop SREGi−1 or the inverted output of flip-flop SREGi+1 is selectively input to the data input terminal of each flip-flop SREGi except the two ends SREG1, SREG175, depending on the scanning direction (forward/backward direction) through inverter INV. All of flip-flops SREG1, SREG2, SREG3, . . . SREG175 have a control signal LR indicating the scanning direction from controller 106 (forward/backward direction) input to the control terminal or the annexed controller.

Although no details will be explained, in second region $A_{EVEN}$ as well as shift register SR-E has a bidirectional data shift function, and flip-flops SREGi of the various sections are wired in the same way as already mentioned, and control signal LR is input from controller 106 in the same way as above.

In said layout, odd-numbered flip-flops SREG1, SREG3, . . . SREG173, SREG175 are arranged in first region $A_{ODD}$, in the same row with respect to corresponding odd-numbered driver circuits DR1, DR3, . . . DR173, DR175 in the Y-direction. Between selection section 14 and drive section 12, one may simply provide one or several (three, in this example) signal lines parallel to the Y-direction between flip-flop SREGi and corresponding driver circuit DRi, and there is no need to bend the wires in the X-direction. Consequently, wiring region size S1 in the Y-direction can be significantly reduced. Also, odd-numbered driver circuits DR1, DR3, . . . DR173, DR175 are arranged in the same row with respect to corresponding odd-numbered output pads OUT1, OUT3, . . . OUT173, OUT175 in the Y-direction. Between drive section 12 and output pad portion 10, one may provide only one signal line parallel to the Y-direction between each driver circuit DRi and corresponding output pad OUTi, and there is no need to bend it in the X-direction. Consequently, wiring region size S3 in the Y-direction can be reduced significantly. Also, since decoder DECi and output buffer OUTBUFi are arranged in the same row in each driver circuit DRi, one may simply provide one or several (three, in this example) signal lines parallel to the Y-direction, and there is no need to bend the wires in the X-direction. Consequently, wiring region size S2 in the Y-direction can be significantly reduced.

The situation in second region $A_{EVEN}$ is the same as that in first region $A_{ODD}$. That is, even-numbered flip-flops SREG2, SREG4, . . . SREG174, SREG176 are arranged in the same row with respect to corresponding even-numbered driver circuits DR2, DR4, . . . DR174, DR176 in the Y-direction. Between selection section 14 and drive section 12, one may simply provide one or several (three, in this example) signal lines parallel to the Y-direction between flip-flop SREGi and corresponding driver circuit DRi, and there is no need to bend the wires in the X-direction. Consequently, wiring region size S1 in the Y-direction can be significantly reduced. Also, even-numbered driver circuits DR2, DR4, . . . DR174, DR176 are arranged in the same row with respect to corresponding even-numbered output pads OUT2, OUT4, . . . OUT174, OUT176 in the Y-direction. Between drive section 12 and output pad portion 10, one may provide only one signal line parallel to the Y-direction between each driver circuit DRi and corresponding output pad OUTi, and there is no need to bend it in the X-direction. Consequently, wiring region size S3 in the Y-direction can be reduced significantly. Also, since decoder DECi and output buffer OUTBUFi are arranged in the same row in each driver circuit DRi, one may simply provide one or several (three, in this example) signal lines parallel to the Y-direction, and there is no need to bend the wires in the X-direction. Consequently, wiring region size S2 in the Y-direction can be significantly reduced.

Figure 4:
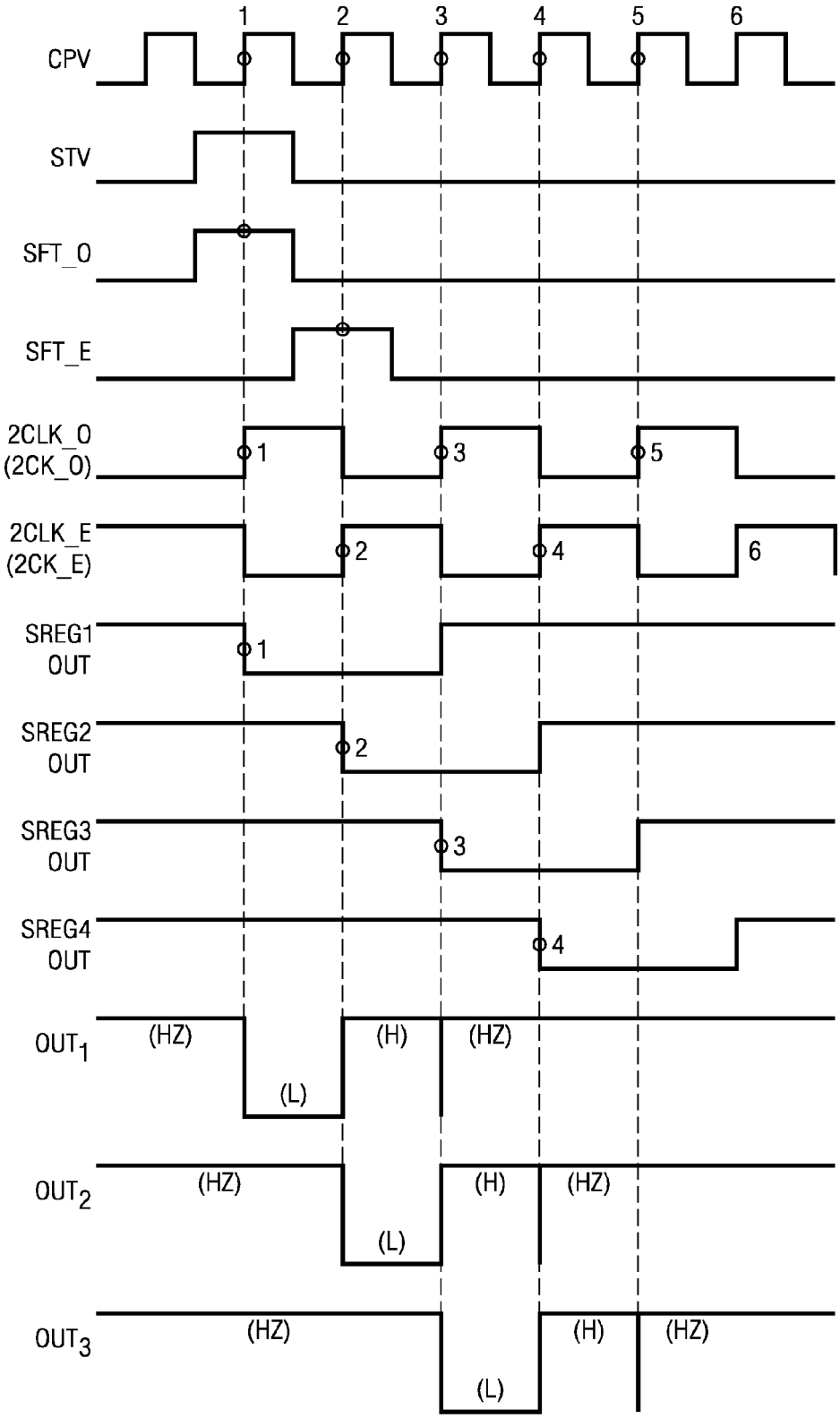
FIG. 4 is a timing chart illustrating the waveforms or timing of the signals in the various portions in the scan driver LSI in said embodiment.

FIG. 4 illustrates the waveforms or timing of the signals in the various sections for this embodiment. In the example shown in this figure, the scanning direction is selected in the forward direction (LR=L).

Fundamental clock signal CPV is provided from controller 106 to generator 16 all the time. Upon this fundamental clock signal CPV, transfer clock generator 20 in generator 16 divides the frequency of clock signal CPV in half, and outputs the obtained first shift pulse 2CLK-O. From inverter 28, second shift pulse 2CLK-E in phase opposite to that of first shift pulse 2CLK-O is output.

At the start of each frame, when H-level start pulse STV is input from controller 106 to generator 16, first of all, shift data generator 18 of generator 16 outputs first shift data SFT-O substantially identical to start pulse STV, and this shift data SFT-O is sent to first flip-flop SREG1 as head flip-flop in first region $A_{ODD}$. Right after that, when first shift pulse 2CLK-O rises (CPV=1, 2CLK-O=1), first flip-flop SREG1 loads or latches H-level shift data SFT-O, and changes the output from H-level, which has been kept until this point, to L-level. Except SREG1, all odd-numbered flip-flops SREGi triggered by first shift pulse 2CLK-O latch L-level and maintain the H-level output.

When the output of first flip-flop SREG1 is changed from H-level to L-level, the output of first driver circuit DR1 is changed from the inactive HZ level (high-impedance H-level (15V)), which has been held until this point, to active L-level (0 V). This L-level drive voltage selectively drives the first scanning line on panel 102 via output pad OUT1 and scan drive terminal ROW1. At this time, signal driver LSI 110 supplies the signal voltage of PWM modulation corresponding to the gradation on each signal line on panel 102 through signal drive terminals COL1, COL2, . . . COL432, and writes the desired image information at each pixel on the first scanning line. On the other hand, the output (L-level) of flip-flop SREG1 is logically inverted by inverter INV, and the H-level shift data is sent to the data input terminal of flip-flop SREG3 of the next stage, that is, the third stage.

As explained above, delayed by 1 cycle of fundamental clock CPV after output of first shift data SFT-O, shift data generator 18 of generator 16 outputs second shift data SFT-E. This shift data SFT-E is sent to second flip-flop SREG2 as the head flip-flop in second region $A_{EVEN}$. Right after that, when second shift pulse 2CLK-E rises (CPV=2, 2CLK-E=2), second flip-flop SREG2 latches said shift data SFT-E, and changes the output from H-level, which has been held until this point, to L-level. Except SREG2, all the even-numbered flip-flops SREGi triggered by second shift pulse 2CLK-E latch L-level and maintain the H-level output.

When the output of second flip-flop SREG2 is changed from H-level to L-level, the output of second driver circuit DR2 is changed from the inactive HZ level, which has been held until this point, to active L-level. This L-level drive voltage (0 V) selectively drives the second scanning line via output pad OUT2 and scan drive terminal ROW2. At this time, signal driver LSI 110 supplies the signal voltage corresponding to each signal line on panel 102 through signal drive terminals COL1, COL2, . . . COL432, and writes the desired image information at each pixel on the second scanning line. On the other hand, the output (L-level) of flip-flop SREG2 is logically inverted by inverter INV, and the H-level shift data is sent to the data input terminal of flip-flop SREG4 of the next stage, that is, the fourth stage.

Also, when clock signal 2CK-O input through corresponding flip-flop SREG1 is changed from H-level to L-level, first driver circuit DR1 responds to the change and switches the drive voltage output to output pad OUT1 from the active L-level (0 V), which has been held until this point, to inactive H-level (15 V).

Then, when first shift pulse 2CLK-O rises (CPV=3, 2CLK-E=3), third flip-flop SREG3 in first region $A_{ODD}$ latches the inverted signal of the output signal of first flip-flop SREG1 on H-level, and changes the output from H-level, which has been held until this point, to L-level. Except SREG3, all the odd-numbered flip-flops SREGi triggered by first shift pulse 2CLK-O latch L-level and output H-level. In particular, the output of first flip-flop SREG1 changes from L-level, which has been held until this point, to H-level.

When the output of third flip-flop SREG3 is changed from H-level to L-level, the output of third driver circuit DR3 is changed from the inactive HZ level, which has been held until this point, to the active L-level. This L-level drive voltage (0 V) selectively drives the third scanning line through output pad OUT3 and scan drive terminal ROW3. At this time, signal driver LSI 110 supplies signal voltages to the signal lines on panel 102 through signal drive terminals COL1, COL2, . . . COL432, and writes the desired image information at the various pixels on the third scanning line. On the other hand, the output (L-level) of flip-flop SREG3 is logically inverted by inverter INV, and the obtained H-level shift data is sent to the data input terminal of fifth flip-flop SREG5 in the next stage.

Also, when clock signal 2CLK-E input through the corresponding flip-flop SREG2 is changed from H-level to L-level, second driver circuit DR2 responds to the change and switches the drive voltage output to output pad OUT2 from the active L-level (0 V), which has been held until this point, to the inactive H-level (15 V). Also, when clock signal 2CLK-O input through the corresponding flip-flop SREG1 is changed from L-level to H-level, first driver circuit DR1 responds to the change and switches the output drive voltage from H-level to HZ-level. Also, in driving the scanning line, first of all, the active L-level (0 V) is switched to the low-impedance H-level (15 V), and charging or discharging on the line is carried out at a high speed. Then, it is switched to the high-impedance HZ-level (15 V), and the line potential is kept nearly constant until the next frame.

Then, when second shift pulse 2CLK-E rises (CPV=4, 2CLK-E=4), fourth flip-flop SREG4 in the second region $A_{EVEN}$ latches the output signal of second flip-flop SREG2 on H-level, and changes the output from H-level, which has been held until this point, to L-level. Except this SREG4, all of the other even-numbered flip-flops SREGi triggered by second shift pulse 2CLK-E latch L-level, and output H-level. In particular, the output of second flip-flop SREG2 is changed from L-level, which has been held until this point, to H-level.

As a response to the change of the output of fourth flip-flop SREG4 from H-level to L-level, the output of fourth driver circuit DR4 is changed from the inactive HZ level, which has been held until this point, to the active L-level. This L-level drive voltage (0 V) selectively drives the fourth scanning line through output pad OUT4 and scan drive terminal ROW4. At this time, signal driver LSI 110 supplies signal voltages to the signal lines on panel 102 through signal drive terminals COL1, COL2, . . . COL432, and writes the desired image information at the various pixels on the fourth scanning line of panel 102. On the other hand, the output (L-level) of flip-flop SREG4 is logically inverted by inverter INV, and the obtained H-level shift data is sent to the data input terminal of sixth flip-flop SREG6 in the next stage.

Also, when clock signal 2CLK-O input through the corresponding flip-flop SREG3 is changed from H-level to L-level, third driver circuit DR3 responds to the change and switches the drive voltage output to output pad OUT3 from the active L-level (0 V), which has been held until this point, to the inactive H-level (15 V). Also, when clock signal 2CLK-E input through the corresponding flip-flop SREG2 is changed from L-level to H-level, second driver circuit DR2 responds to the change and switches the driving output voltage from H-level to HZ-level.

In the later clock cycles, the same operation as above is repeated for flip-flops SREGi and driver circuits DRi of the later stages. As a result, during one frame period, one by one, all of the scanning lines on panel 102 are sequentially driven selectively from the upper side or from the lower side in line-sequential cycles.

Also, when the scanning direction on panel 102 is in the backward direction, while first shift data SFT-O is input to the initial flip-flop, that is, the $175^{th}$ flip-flop SREG175 in first region $A_{ODD}$, second shift data SFT-E is input to the second flip-flop, that is, the $176^{th}$ flip-flop SREG176 in second region $A_{EVEN}$. In first and second shift registers SR-O and SR-E, one may simply invert the transfer direction of shift data SFT-O and SFT-E from that in the aforementioned operation.

Figure 9:
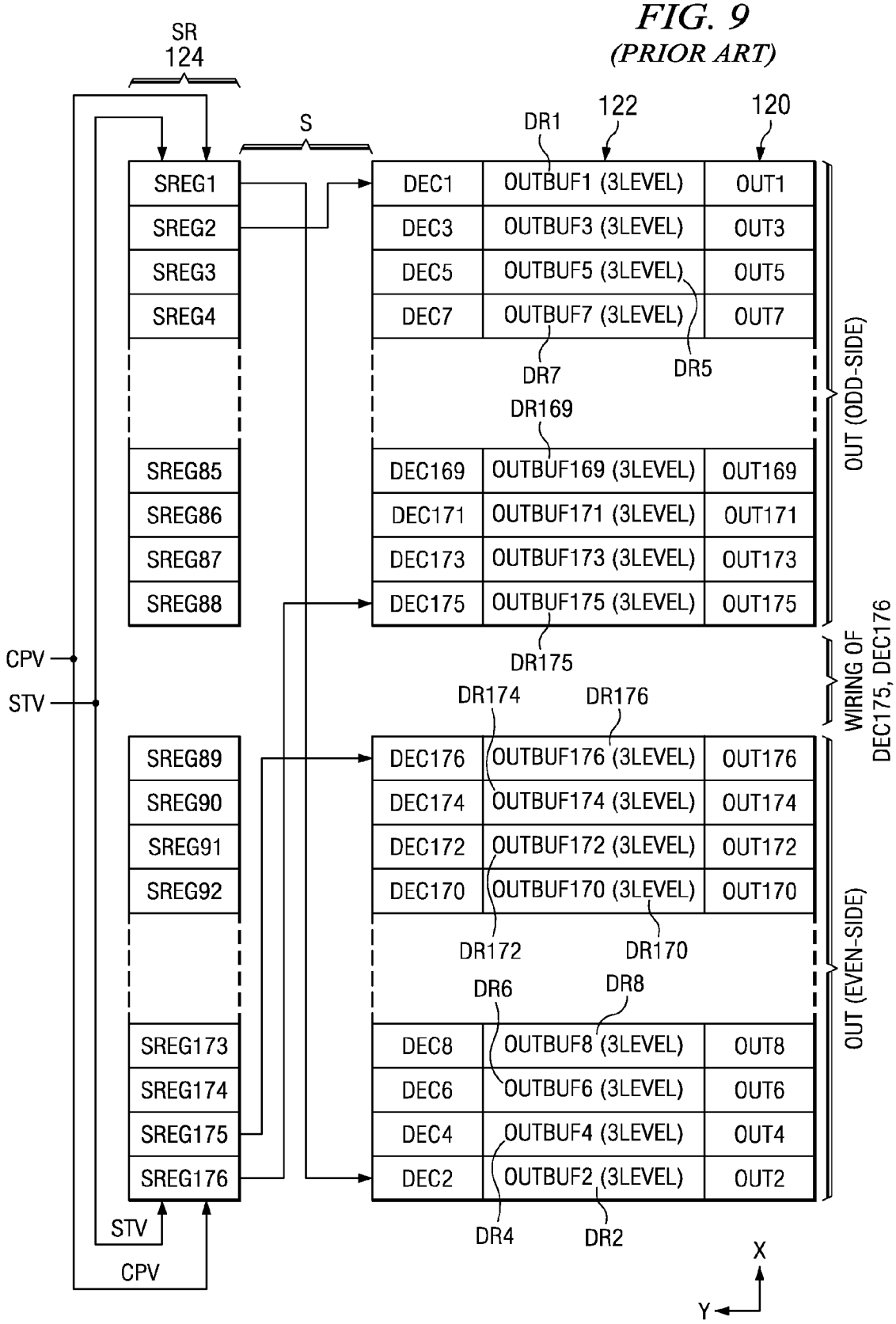
FIG. 9 (PRIOR ART)
FIG. 9 is a block diagram illustrating the circuit configuration and layout of the main portion of a conventional scan driver LSI.
Figure 10:
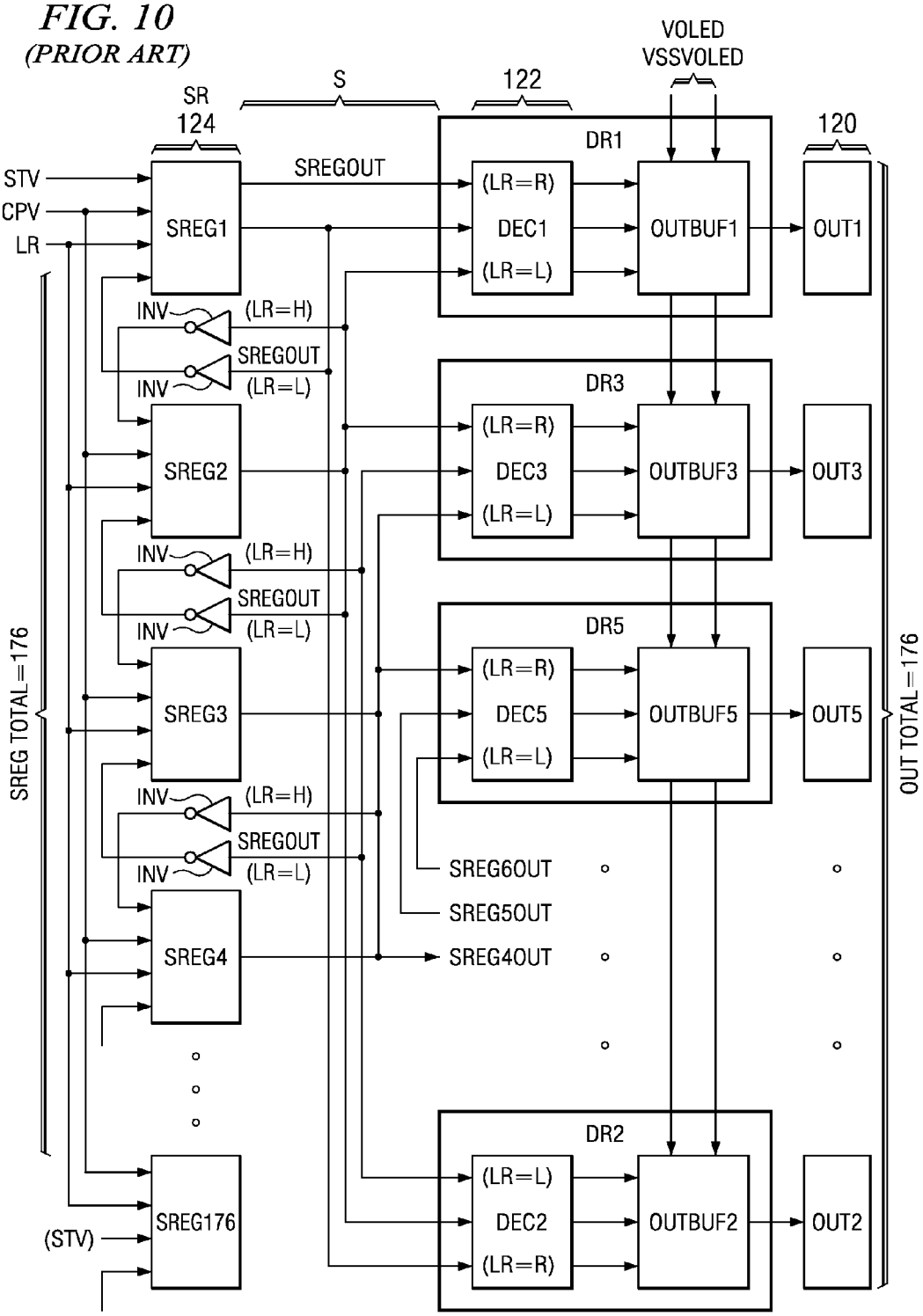
FIG. 10 (PRIOR ART)
FIG. 10 is a block diagram illustrating in detail the circuit configuration and layout of FIG. 9.
Figure 11:
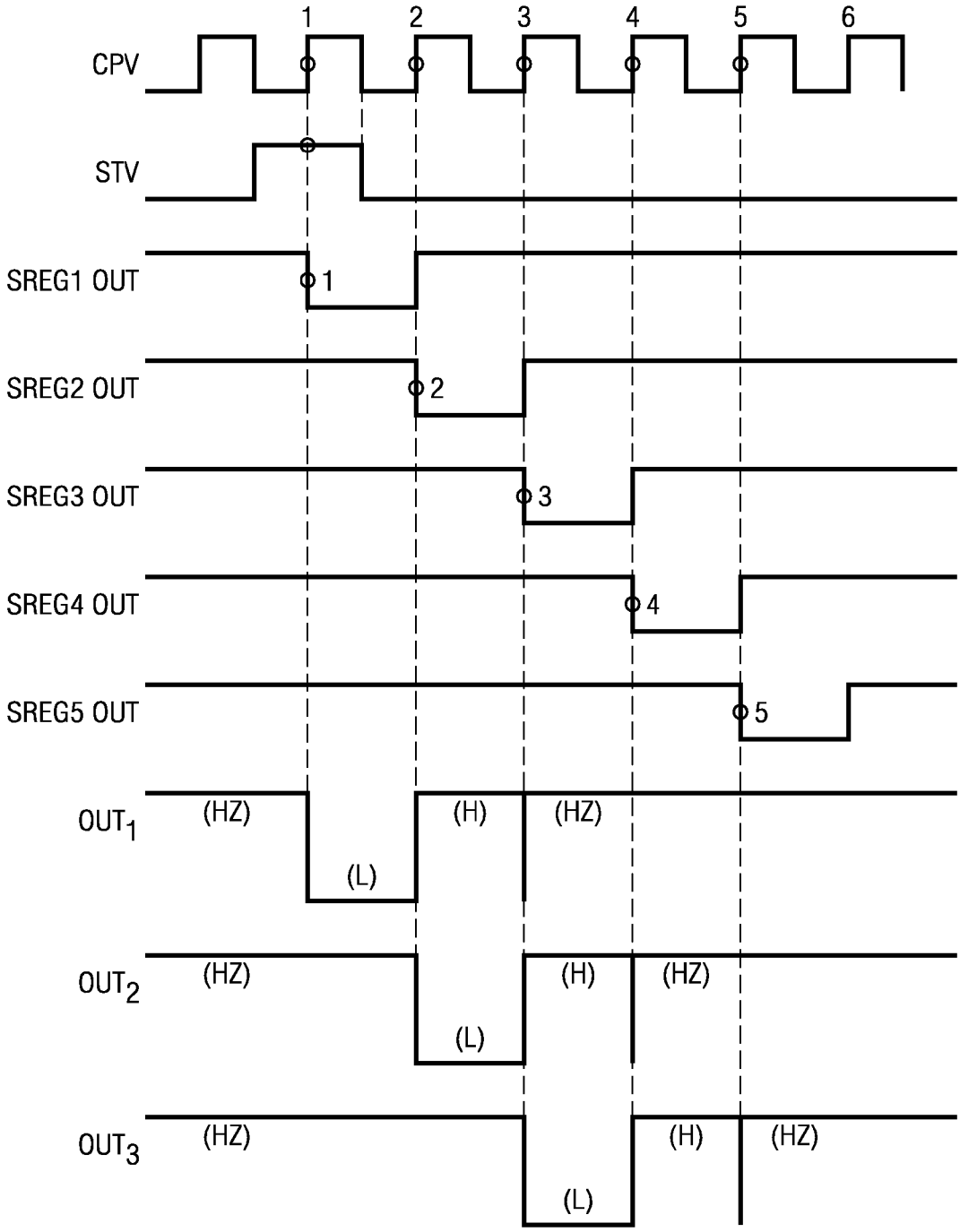
FIG. 11 (PRIOR ART)
FIG. 11 is a timing chart illustrating the waveform or timing of the signals in the various portions of the conventional scan driver LSI.
Figure 12:
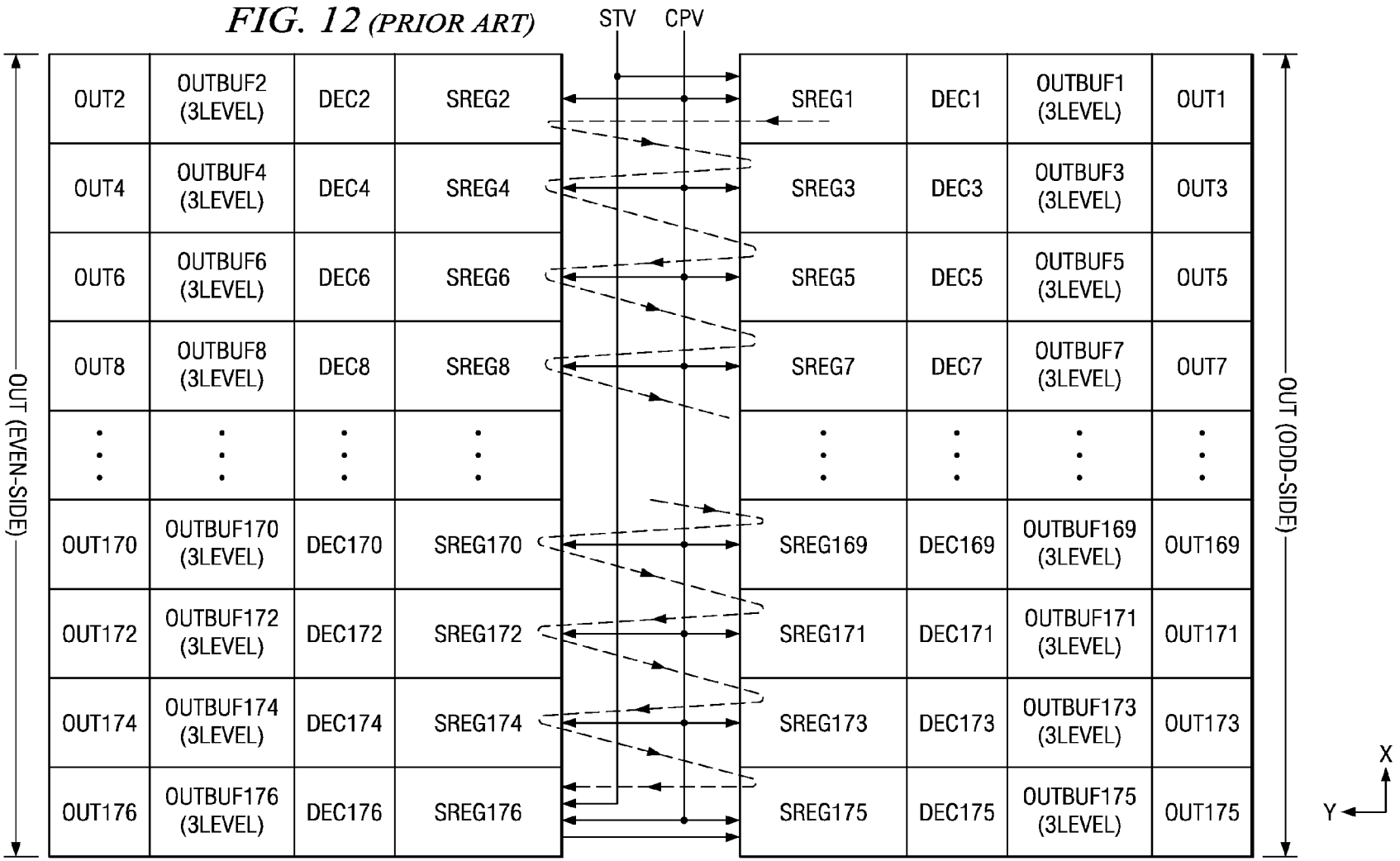
FIG. 12 (PRIOR ART)
FIG. 12 is a block diagram illustrating in detail another circuit configuration and layout of the conventional scan driver LSI.

As explained in the above, in this embodiment, among output pad section 10, drive section 12 and selection section 14, driver circuits DRi and selection circuits, that is, flip-flops, SREGi corresponding to various output pads OUTi are arranged in the same row in the Y-direction (chip width direction), and said sections are connected to each other by wires extending in the Y-direction. Consequently, the size of the Y-direction wiring region among various portions 10, 12, 14 can be reduced significantly. As an example, in the prior art (FIG. 9), the chip width is 1319.05 (m. On the other hand, in this embodiment, the chip width can be reduced to 1088.05 (m (shortened by 231 (m, or about 15%). That is, the chip area can be reduced by about 15%. This means that one can increase the number of chips that can be manufactured from the semiconductor wafer of the same size as that in the prior art by about 15%.

In the aforementioned embodiment, the scanning lines are driven with respect to 3-value levels, and the scanning direction can be switched. Consequently, three signals are sent from selection section 14 to each driver circuit DRi of drive section 12. However, when the scanning lines are driven with respect to 2-value levels, and the scanning direction is fixed, one may adopt a wiring structure in which only one output signal is sent from each flip-flop SREG 1 of selection section 14 to each driver circuit DRi of drive section 12, and it is possible to eliminate decoder DECi in each driver circuit DRi. Also, in the above embodiment, the number 176 for output pads OUT, driver circuits DR and selection circuits SREG is merely an example, and one can select the number at will corresponding to the number of scanning lines.

The scan driver LSI of this invention is not limited to the organic EL display in the aforementioned embodiment. It may be adopted in any display that adopts line-sequential scanning in the same matrix display system, such as liquid crystal displays, LED displays, etc.

As explained above, the integrated circuit for scan driving in this invention can significantly reduce the chip size, and it can improve the performance with respect to productivity, cost, and assembling properties.

The invention claimed is:

1. An integrated circuit for scan driving being used in sequentially selecting and driving scanning lines in a display, which has said plural scanning lines and plural signal lines arranged crossing each other in a matrix configuration, and which has a pixel arranged at each cross point; in this integrated circuit for scan driving, comprising:

a chip, having plural output pads arranged as a column in a first direction, plural drive circuits for driving said scanning lines to the active state through said output pads, respectively, and plural selection circuits for individually selecting said driver circuits in a line-sequential scanning cycle in an order corresponding to the order of said scanning lines;

the odd-numbered output pads, driver circuits and selection circuits corresponding to odd-numbered scanning lines are all arranged in a first region, the even-numbered output pads, driver circuits and selection circuits corresponding to the even-numbered scanning lines being all arranged in a second region adjacent to said first region in said first direction;

said first region, in an order corresponding to the order of said odd-numbered scanning lines, said odd-numbered output pads, driver circuits and selection circuits being arranged as columns in said first direction, respectively, and, at the same time, said output pads, driver circuits and selection circuits corresponding to each of the scanning lines are arranged in the same row in the second direction nearly orthogonal to said first direction;

in said second region, in an order corresponding to the order of said even-numbered scanning lines, said even-numbered output pads, driver circuits and selection circuits are arranged as columns in said first direction, and, at the same time, said output pads, driver circuits and selection circuits corresponding to each of the scanning lines being arranged in the same row in said second direction;

said odd-numbered selection circuits are made of individual flip-flops that overall form the first shift register; the first shift data provided by the frame period is transferred sequentially to the latter-stage flip-flops in synchronization with the first transfer clock signal at a frequency half that of the line-sequential scanning cycle; by means of the output signals of the flip-flops with said first shift data latched in them, the corresponding driver circuits are selected;

said even-numbered selection circuits are made of individual flip-flops that overall form the second shift register; the second shift data provided by frame period is transferred sequentially to the latter-stage flip-flops in synchronization with the second transfer clock signal at a frequency half that of the line-sequential scanning cycle and in a phase opposite to that of said first transfer clock signal; and, by means of the output signals of the flip-flops with said second shift data latched in them, the corresponding driver circuits are selected.

2. The integrated circuit for scan driving as in claim 1 wherein said first and second shift registers allow bidirectional transfer of, respectively, said first and second shift data.

3. The integrated circuit for scan driving as in claim 2 wherein said chip is assembled by means of TCP.

4. The integrated circuit for scan driving as in claim 1 wherein said first direction corresponds to the longitudinal direction of said chip, and said output pads are arranged as a column along one edge extending in the longitudinal direction of said chip.

5. The integrated circuit for scan driving described in claim 4 wherein the input pads for input of the desired power source voltage or signal are arranged as a column along the other edge in the longitudinal direction of said chip.

6. An integrated circuit for scan driving being used in sequentially selecting and driving scanning lines in a display, which has said plural scanning lines and plural signal lines arranged crossing each other in a matrix configuration, and which has a pixel arranged at each cross point; in this integrated circuit for scan driving, comprising:

a chip, having plural output pads arranged as a column in a first direction, plural drive circuits for driving said scanning lines to the active state through said output pads, respectively, and plural selection circuits for individually selecting said driver circuits in a line-sequential scanning cycle in an order corresponding to the order of said scanning lines;

the odd-numbered output pads, driver circuits and selection circuits corresponding to odd-numbered scanning lines are all arranged in a first region, the even-numbered output pads, driver circuits and selection circuits corresponding to the even-numbered scanning lines being all arranged in a second region adjacent to said first region in said first direction;

said first region, in an order corresponding to the order of said odd-numbered scanning lines, said odd-numbered output pads, driver circuits and selection circuits being arranged as columns in said first direction, respectively, and, at the same time, said output pads, driver circuits and selection circuits corresponding to each of the scanning lines are arranged in the same row in the second direction nearly orthogonal to said first direction;

in said second region, in an order corresponding to the order of said even-numbered scanning lines, said even-numbered output pads, driver circuits and selection circuits are arranged as columns in said first direction, and, at the same time, said output pads, driver circuits and selection circuits corresponding to each of the scanning lines being arranged in the same row in said second direction;

wherein said integrated circuit includes:

a transfer clock generator that divides the fundamental clock signal that defines the cycle of line-sequential scanning in half, and a shift data generator that generates said first and second shift data in two consecutive cycles of said fundamental clock signal corresponding to the start pulse that indicates the timing of the start of a frame.

7. The integrated circuit for scan driving as in claim 6 wherein said first direction corresponds to the longitudinal direction of said chip, and said output pads are arranged as a column along one edge extending in the longitudinal direction of said chip.

8. The integrated circuit for scan driving described in claim 7 wherein the input pads for input of the desired power source voltage or signal are arranged as a column along the other edge in the longitudinal direction of said chip.

9. A type of integrated circuit for scan driving for sequentially supplying scan drive signal to the scanning electrodes of a display device; comprising:

a first shift register, which has plural register circuits connected in series, and which sequentially transfers the first shift data corresponding to a first clock signal, a first drive section, which has plural driver circuits corresponding to the plural register circuits of said first shift register, respectively, and which has said plural driver circuits output drive signals corresponding to said first shift data outputs from the plural register circuits of said first shift register, respectively, a second shift register, which has plural register circuits connected in series, and which sequentially transfers the second shift data shifted in phase by half a period of a second clock signal with respect to said first shift data corresponding to the second clock signal with its phase deviated by 180° from said first clock signal, and a second drive section, which has plural driver circuits corresponding to the plural register circuits of said second shift register, respectively, and which has said plural driver circuits output drive signals corresponding to said second shift data outputs from the plural register circuits of said second shift register, respectively;

said drive signals are output alternately from the various driver circuits of said first drive section and the various driver circuits of said second drive section, corresponding to said first or second shift data;

wherein said integrated circuit has a signal generator, to which the reference clock signal having a frequency double that of said first and second clock signals as well as a start pulse are input, and which generates said first and second clock signals and said first and second shift data on the base of said reference clock signal and said start pulse.

10. The integrated circuit for scan driving as in claim 9 wherein the register circuits of said first shift register and the driver circuits of said first drive section are arranged in order of activation along a first direction; and the register circuits of said second shift register and the driver circuits of said second drive section are arranged in order of activation along said first direction.

11. The integrated circuit for scan driving as in claim 10 wherein said first and second shift registers are bidirectional shift registers that allow transfer of shift data bidirectionally; said first shift data is supplied to the register circuit in the initial stage or the register circuit in the final stage of said first shift register, and said second shift data is supplied to the register circuit of the initial stage or the register circuit of the final stage of said second shift register.

12. The integrated circuit for scan driving as in claim 10 wherein said first and second shift registers and said first and second drive sections are formed on a rectangular semiconductor chip, and said first direction is the longitudinal direction of said semiconductor chip.

13. The integrated circuit for scan driving described in claim 12 wherein the odd-numbered drive signals are sequentially output from the various driver circuits of said first drive section, and the even-numbered drive signals are sequentially output from the driver circuits of said second drive section.

* * * * *